US009605689B2

(12) United States Patent
Glauber

(10) Patent No.: US 9,605,689 B2
(45) Date of Patent: Mar. 28, 2017

(54) AIR MOTOR

(71) Applicant: WILDEN PUMP AND ENGINEERING LLC, Grand Terrace, CA (US)

(72) Inventor: Carl J. Glauber, Mission Viejo, CA (US)

(73) Assignee: Wilden Pump and Engineering LLC, Grand Terrace, CA (US)

( * ) Notice: Subject to any disclaimer, the term of this patent is extended or adjusted under 35 U.S.C. 154(b) by 46 days.

(21) Appl. No.: 14/921,906

(22) Filed: Oct. 23, 2015

(65) Prior Publication Data

US 2016/0115973 A1 Apr. 28, 2016

Related U.S. Application Data

(60) Provisional application No. 62/068,433, filed on Oct. 24, 2014.

(51) Int. Cl.

| | |
|---|---|
| ***F04B 45/00*** | (2006.01) |
| ***F15B 11/10*** | (2006.01) |
| ***F15B 15/18*** | (2006.01) |
| ***F04B 43/073*** | (2006.01) |
| ***F04B 45/053*** | (2006.01) |

(52) U.S. Cl.

CPC ..... *F15B 11/10* (2013.01); *F04B 43/073* (2013.01); *F04B 43/0736* (2013.01); *F04B 45/053* (2013.01); *F15B 15/18* (2013.01)

(58) Field of Classification Search

CPC .... F16B 11/10; F04B 43/073; F04B 45/0736; F04B 45/053

USPC ..... 60/370; 417/395

See application file for complete search history.

(56) References Cited

U.S. PATENT DOCUMENTS

| | | | | |
|---|---|---|---|---|
| 3,071,118 | A | 1/1963 | Wilden | |
| 3,555,966 | A | 1/1971 | Coniglio | |
| 4,247,264 | A | 1/1981 | Wilden | |
| 4,846,045 | A | 7/1989 | Grach et al. | |
| 5,169,296 | A | 12/1992 | Wilden | |
| 5,213,485 | A | 5/1993 | Wilden | |
| 5,277,555 | A * | 1/1994 | Robinson | F01L 25/063 137/625.37 |
| 5,349,895 | A | 9/1994 | DiCarlo | |
| 5,957,670 | A | 9/1999 | Duncan et al. | |

(Continued)

OTHER PUBLICATIONS

International Search Report dated Jan. 21, 2016 & Written Opinion from PCT/US15/57345—Oct. 26, 2015.

*Primary Examiner* — Thomas E Lazo
*Assistant Examiner* — Daniel Collins
(74) *Attorney, Agent, or Firm* — Karish & Bjorgum, PC

(57) ABSTRACT

An air motor has a source of pressurized air, two air chambers, a pilot valve and a directional control valve. The spool of the directional control valve is of the unbalanced type and includes a piston surface in continuous communication with atmosphere through an exhaust port and a pressurized restricted port in alternating communication with the large end of the spool and the piston surface. The alternating communication of the source of pressurized air through the restricted port is restricted relative to the continuous communication of the piston surface with atmosphere. At the point of shift of the directional control valve, the piston surface is in communication with the source of pressurized air through the restricted port.

6 Claims, 4 Drawing Sheets

(56) References Cited

U.S. PATENT DOCUMENTS

| | | | |
|---|---|---|---|
| 8,360,745 | B2 | 1/2013 | Dietzsch et al. |
| 2014/0377086 | A1 | 12/2014 | Glauber |

* cited by examiner

AIR MOTOR

CROSS-REFERENCE TO RELATED APPLICATIONS

The present application claims priority to U.S. Provisional Patent Application No. 62/068,433, filed on Oct. 24, 2014, and entitled "Air Motor," the content of which is relied upon and incorporated herein by reference in its entirety.

BACKGROUND OF THE INVENTION

The field of the present invention is reciprocating air motors.

Devices having double pistons and diaphragms driven by compressed air directed through an air motor are well known. Reference is made to U.S. Pat. Nos. 8,360,745; 5,957,670; 5,213,485; 5,169,296; and 4,247,264; and to U.S. Patent Publication No. 2014/0377086. The disclosures of the aforementioned U.S. Patents and patent publication are incorporated herein by reference in their entirety. These air driven diaphragm pumps employ air motors using feedback control systems to provide reciprocating compressed air for driving the pumps.

Common among many of such prior devices directed to air driven diaphragm pumps is the presence of an air motor housing having air chambers facing outwardly to cooperate with pump pistons and diaphragms coupled by a common shaft. Outwardly of the pump diaphragms are pump chamber housings, inlet manifolds and outlet manifolds. Passageways transition from the pump chamber housings to the manifolds. Ball check valves are positioned in both the inlet passageways and the outlet passageways. An actuator mechanism associated with the air motor housing between the air chambers includes the common shaft reciprocating therethrough and coupled with the diaphragms located between the air chambers and pump chambers by central pistons.

The actuator between the air chambers for air driven pumps commonly includes a directional control valve that controls air flow to alternate pressure and exhaust to and from each of the air chambers, resulting in reciprocation of the pump. The directional control valve is controlled by a pilot system controlled in turn by the position of the pump diaphragms or pistons. Thus, a feedback control mechanism is provided to convert a constant air pressure into a reciprocating distribution of pressurized air to each operatively opposed air chamber.

Actuators defining reciprocating air distribution systems are employed to substantial advantage when shop air or other convenient sources of pressurized air are available. Other pressurized gases are also used to drive these products. The term "air" is generally used to refer to any and all such gases. Driving products with pressurized air is often desirable because such systems avoid components which can create sparks. The actuators can also provide a continuous source of pump pressure by simply being allowed to come to a stall point with the pressure equalized by the resistance against the pump. As resistance against the pump is reduced, the system will again begin to operate creating a system of operations on demand.

A vast variety of materials of greatly varying viscosity and physical nature are able to be pumped using such systems. In using such actuators to drive such pumps, greatly varying demands can be experienced. Viscosity of the pump material, suction head or discharge head and desired flow rate impact operation. Typically the source of pressurized air is relatively constant. In U.S. Pat. No. 8,360,745 a mechanism for predictably adjusting flow restriction is disclosed. In U.S. Patent Publication No. 2014/0377086, flow restriction is created responsive to pump position. With variations in pump loads and inlet flow restrictions, the feedback control mechanism of air motors can result in stalling of the actuator mechanism during shifting of the directional control valve.

SUMMARY OF THE INVENTION

The present invention is directed to an air motor having a source of pressurized air, two air chambers and a directional control valve. To handle process air, the directional control valve includes two air distribution passages in communication with the two air chambers, respectively, and a reciprocating valve spool which has a land between the two air distribution passages. A first air inlet passage is in continuous communication with the source of pressurized air and with the land between the two air distribution passages. A pilot valve system may control the reciprocation of the spool of the directional control valve.

The reciprocating valve spool further has three piston surfaces interactive with control air to the directional control valve. A first piston surface is in continuous communication with the source of pressurized air. The second piston surface, larger than the first piston surface, is in alternating communication with the source of pressurized air and with atmosphere. The third piston surface is in continuous communication with atmosphere through an exhaust port.

The directional control valve further includes a restricted port. The restricted port is in continuous communication with the source of pressurized air and in alternating communication with the second piston surface and the third piston surface. The alternating communication of the source of pressurized air through the restricted port is restricted relative to the continuous communication of the third piston surface with atmosphere. The relative flow restriction depends on the size and pneumatic dynamics of the air valve and is best empirically determined to provide a partial pressure above atmosphere. For optimum operation, when the land traverses the air inlet passage, the third piston surface is in communication with the source of pressurized air through the restricted port.

Accordingly, it is an object of the present invention to provide an improved reciprocating air motor. Other and further objects and advantages will appear hereinafter.

DETAILED DESCRIPTION OF THE PREFERRED EMBODIMENT

Figure 1:
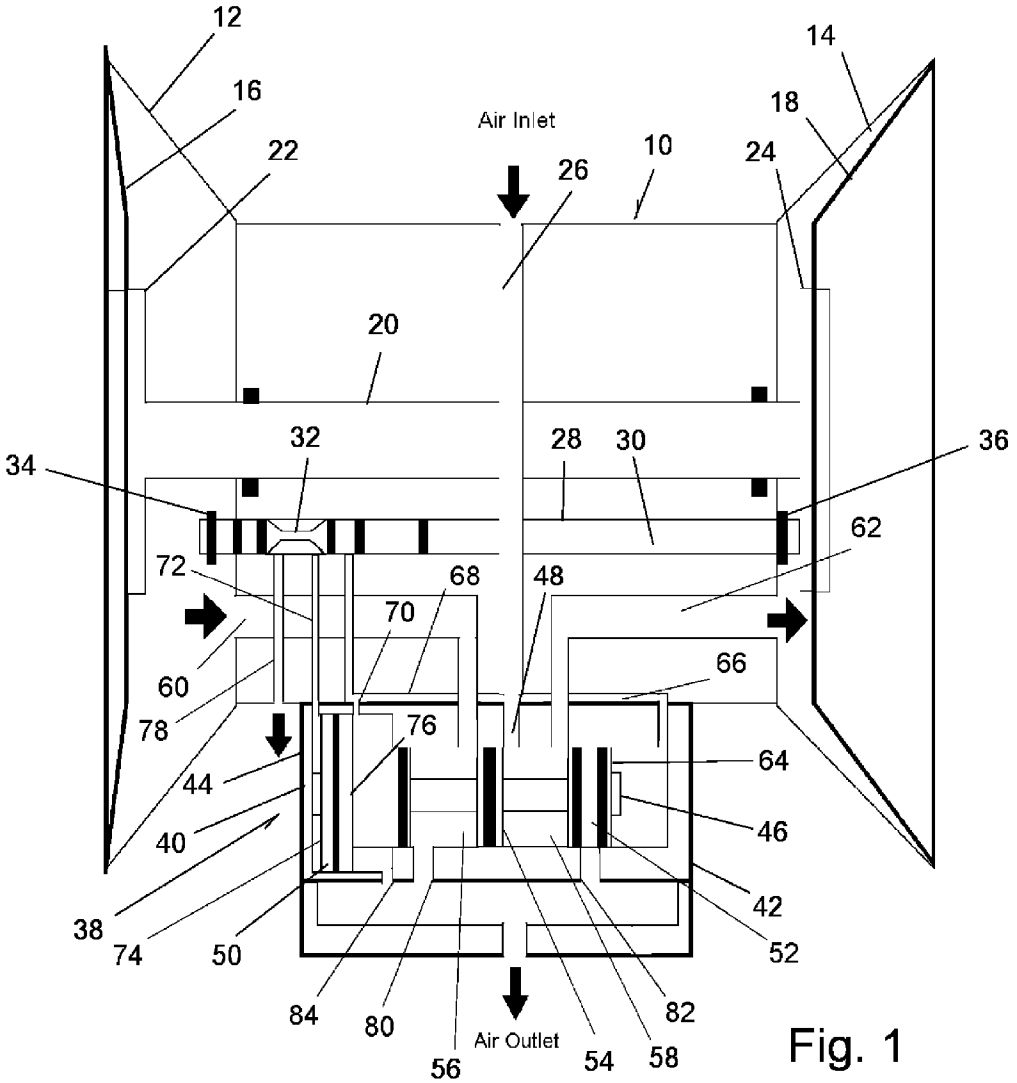
FIG. 1 is a schematic of an air motor showing first positions of a directional control valve and a pilot valve immediately after a shift of the directional control valve.

Turning in detail to the drawings, the air motor 10 includes opposed air chambers 12, 14 each closed by a diaphragm 16, 18, respectively. The body of the air motor 10 includes a passageway therethrough to receive a shaft 20 which includes pistons 22, 24 at the ends thereof to retain the diaphragms 16, 18. An air inlet 26 provides a source of pressurized air which may be shop air, an air compressor or the like with flow unrestricted or restricted by active or passive control valving. A pilot valve 28 also extends through the body of the air motor 10 and into the air chambers 12, 14. The pilot valve 28 engages the pistons 22, 24 with lost motion in a conventional manner. The pilot valve 28 includes the pilot shaft 30, a longitudinal passageway 32 and collar stops 34, 36. All other solid black elements depicted on the pilot shaft 30 and elsewhere in the figures represent seals.

A directional control valve 38 is associated with the body of the air motor 10. The directional control valve 38 includes a valve cylinder 40. The valve cylinder 40 defines a cylindrical cavity closed at each end with a first portion 42 having a first diameter and a second portion 44 having a second, larger diameter. A valve spool 46 is positioned to reciprocate within the cylindrical cavity defined by the valve cylinder 40. The valve spool 46 is symmetrical about a central axis of rotation.

The air inlet 26 is in communication with a process air inlet passage 48 to direct process air into the cylindrical cavity of the directional control valve 38. The spool 46 in the cylindrical cavity includes two pistons 50, 52 which are spaced apart to either side of the process air inlet passage 48. A land 54 between the pistons 50, 52 is spaced therefrom to create process air passages 56, 58 across the valve. Air distribution passages 60, 62 communicate process air from the first portion 42 of the cylindrical cavity to the air chambers 12, 14, respectively. The pistons 50, 52 and the land 54 each have one or more annular seals. Air is blocked by these seals from flowing longitudinally in the cylindrical cavity across these seals but can flow around and longitudinally of the pistons 50, 52 and the land 54 within the cylindrical cylinder up to these seals. Thus, the timing of port openings and closings is determined by the seals rather than the body of the pistons 50, 52 and land 54.

Control air is communicated from the air inlet 26 to a first piston surface 64 on the piston 52 through a first control air inlet passage 66. The first control air inlet passage 66 is continuously open and in communication with the first piston surface 64. A second control air inlet passage 68 extends to a restricted port 70 in the second, larger diameter portion 44 of the cylindrical cavity. The second control air inlet passage 68 also supplies control air to the longitudinal passageway 32 of the pilot valve 28. A control passage 72 extends from the pilot valve 28 to the end of the second, larger diameter portion 44 in continuous communication with a second piston surface 74 of the piston 50. The piston 50 further includes a third piston surface 76. An exhaust passageway 78 extends from the pilot valve 28 to atmosphere. The pilot valve 28 controls communication of the second control air inlet passage 68 and the exhaust passageway 78 with the control passage 72

Exhaust ports 80, 82 extend from the first portion 42 of the cylindrical cavity to atmosphere through a muffler. The exhaust ports 80, 82 are controlled by the valve spool 46 to alternately discharge process air from the passageways 56, 58, respectively. A control exhaust port 84 is continually in communication with the third piston surface 76. The port 70 is restricted relative to the control exhaust port 84, which is continuously open to atmosphere, such that flow through the port 70 when open to communicate with the third piston surface 76 provides a partial pressure above atmosphere against the third piston surface 76 lower than the pressure in the second control air inlet passage 68.

In operation, the figures illustrate successive positions of the air motor during operation. In FIG. 1, the directional control valve 38 has just completed a shift toward the large end of the cylindrical cavity. The shaft 20 and associated pistons 22, 24 are moving in the direction indicated by the flow arrows; and the pilot valve 28 is positioned to exhaust the large end of the cylindrical cavity associated with the second piston surface 74.

Process air flows through the process air inlet passage 48 to the passage 58 where it is then communicated through the air distribution passage 62 to the air chamber 14. Control air pressure through the first control air inlet passage 66 communicates with the first piston surface 64 to bias the spool 46 toward the large end of the cylindrical cavity. The pilot valve shaft 30 having been forced by the piston 24 to one end of its stroke against the collar stop 36 communicates the control passage 72 through the longitudinal passageway 32 to the exhaust passage 78. Pressure on the second piston surface 74 is reduced to atmospheric.

Control air through the second control air inlet passage 68 is shut off at the pilot valve 28 but is open through the restricted port 70 to communicate with the third piston surface 76 and to flow through the continuously open control exhaust port 84, providing partial pressure to the third piston surface 76. The restricted port 70 and the exhaust port 84 are intentionally configured to add partial pressure against the third piston surface 76 such that the first piston surface 64 and the third piston surface 76 cooperate together to force the valve spool 46 against the large end of the cylindrical cavity. The process air inlet passage 48 is continuously in communication with the land 54 which traverses the process air inlet passage 48 to control air to one or the other of the passageways 56, 58. As the exhaust port 82 is closed by the piston 52, and as the exhaust port 80 is open on the other side of the land 54, process air is introduced through air distribution passage 62 and exhausted through air distribution passage 60.

Figure 2:
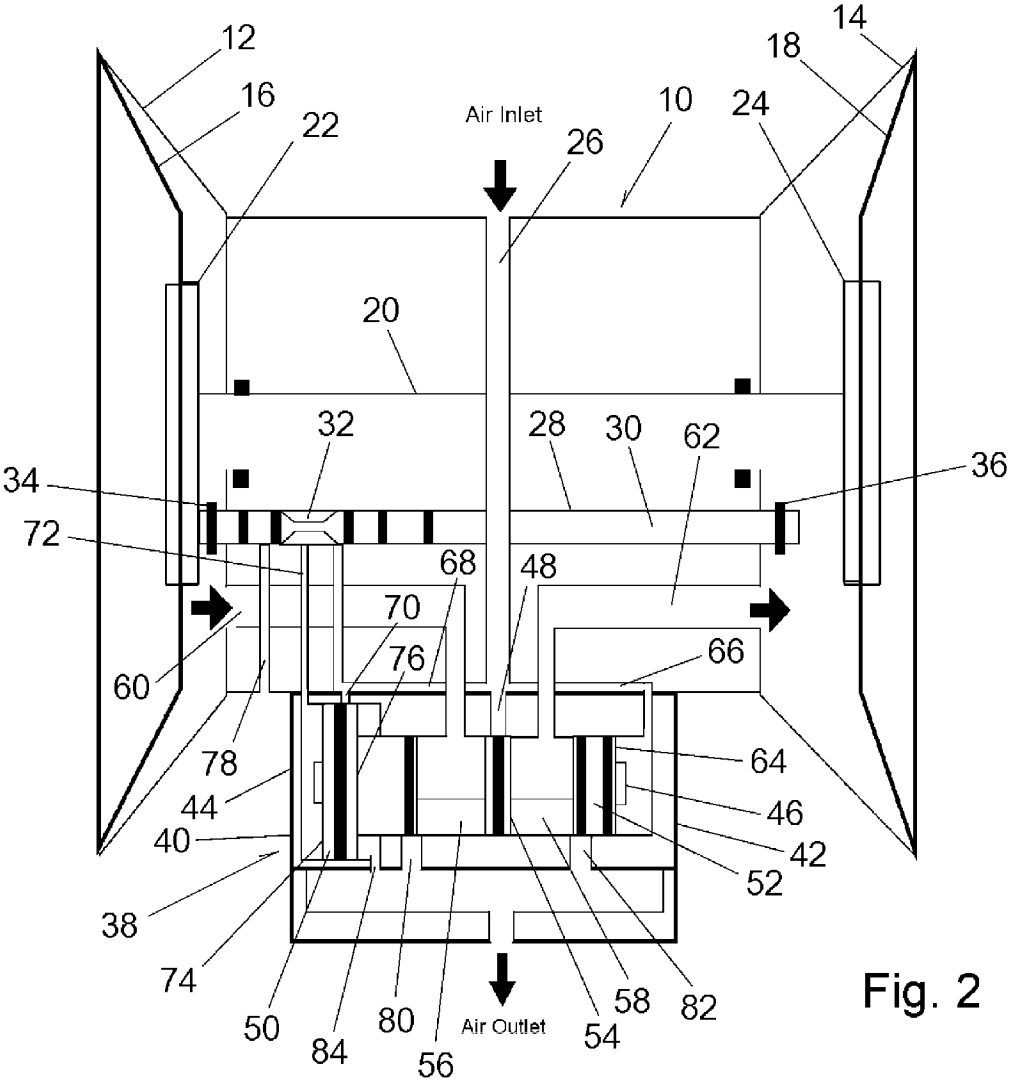
FIG. 2 is a schematic of the air motor showing the positions of the directional control valve and the pilot valve during shifting of the directional control valve in sequence following the position of the air motor as shown in FIG. 1.

Turning to FIG. 2, the air motor has progressed under the influence of process air entering the air chamber 14 through the air distribution passage 62 to move the pilot shaft 30 of the pilot valve 28 toward the air chamber 14 through its engagement with the piston 22. In this position, the exhaust passage 78 is no longer in communication with the longitudinal passageway 32 of the pilot valve 28; the control passage 72 continues to be in communication with the longitudinal passageway 32; and the second control air inlet passage 68 is just being exposed to the longitudinal passageway 32 so as to communicate with the control passage 72. Such communication through the longitudinal passageway 32 moves the directional control valve spool 46 toward the small end of the cylindrical cavity by providing control air pressure to the second piston surface 74. The first piston surface 64 is shown to be smaller than the second piston surface 74. Therefore, the force on the second piston surface 74 is greater than the force constantly acting on the first piston surface 64 to move the valve spool 46 toward the small end of the cylindrical chamber when both are equally pressurized. The exhaust port 84 remains constantly open.

The land 54 is shown in FIG. 2 to be just traversing the process air inlet passage 48. The land 54 remains in continuous communication with the process air inlet passage 48; but the process air may be substantially or completely closed off from the passages 56, 58 for an instant during the shift of the directional control valve 38. With the land 54 traversing the process air inlet passage 48, the restricted port 70 has not yet been closed off by the seal of the piston 50 and remains in communication with the third piston surface 76.

Figure 3:
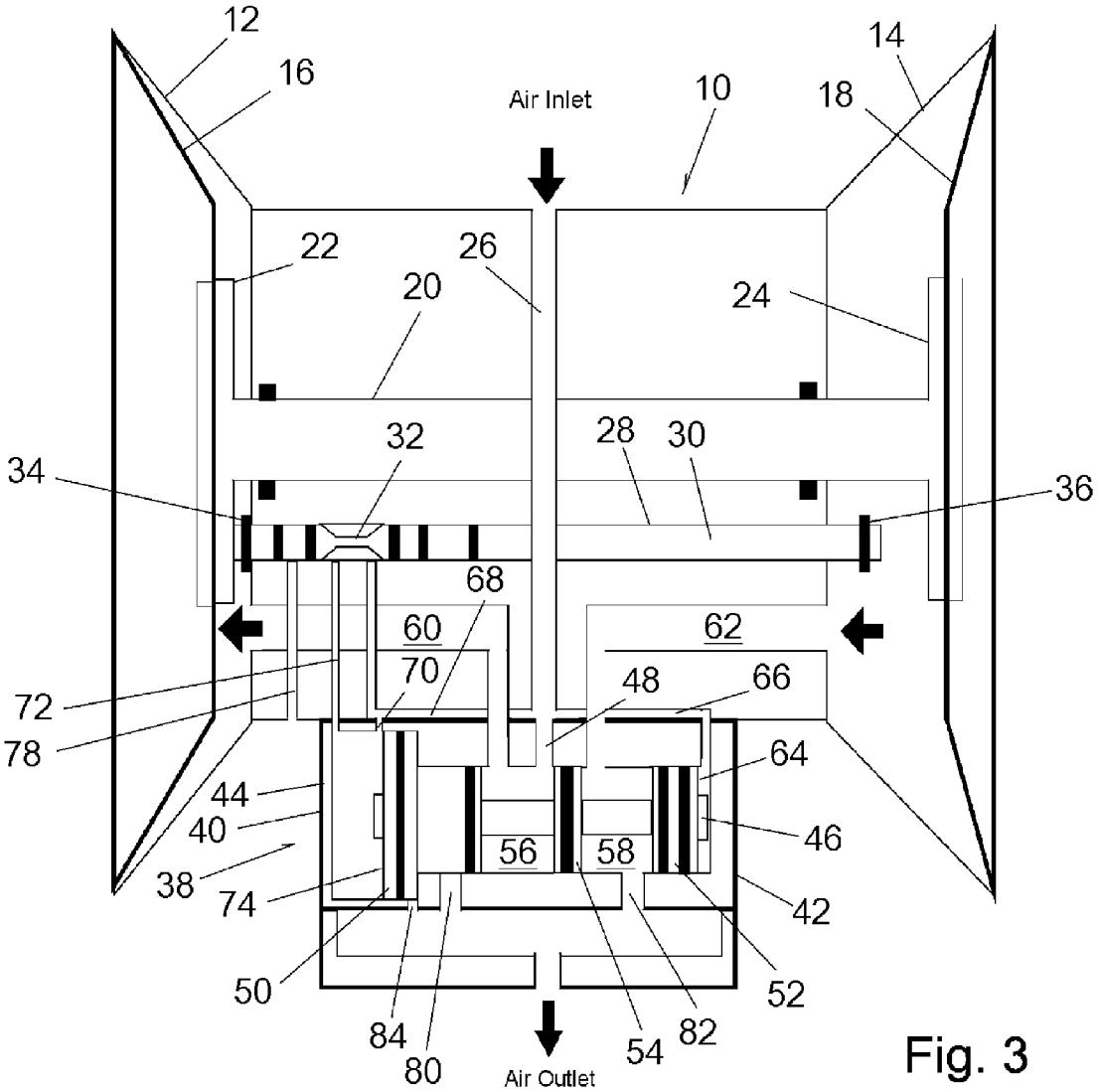
FIG. 3 is a schematic of the air motor showing the positions of the directional control valve and the pilot valve at the end of the shift of the directional control valve in sequence following the position of the air motor as shown in FIG. 2.

Turning to FIG. 3, the air motor 10 has now completed its stroke toward the air chamber 14. This has driven the pilot shaft 30 against the collar stop 34. At this point, the valve spool 46 is also fully shifted to the small end of the cylindrical cavity of the directional control valve 38. In this position, process air through the process air inlet passage 48 is directed to the passage 56 and through the air distribution passage 60 to pressurize the air chamber 12. The exhaust port 80 is covered by the valve spool 46 to sustain this pressure. Exhaust port 82 is uncovered from the movement of the piston 52 such that spent air from the air distribution passage 62 exhausts to atmosphere.

With the pilot valve shaft 30 positioned as indicated, the longitudinal passageway 32 fully communicates the control air inlet passage 68 with the control passage 72. Further, the restricted port 70 is also open to communicate with the second piston surface 74 to increase flow to pressurize the second piston surface 74 to assist in completing the shift of the valve spool 46 to the position shown. The third piston surface 76 also remains in communication with the exhaust port 84.

Figure 4:
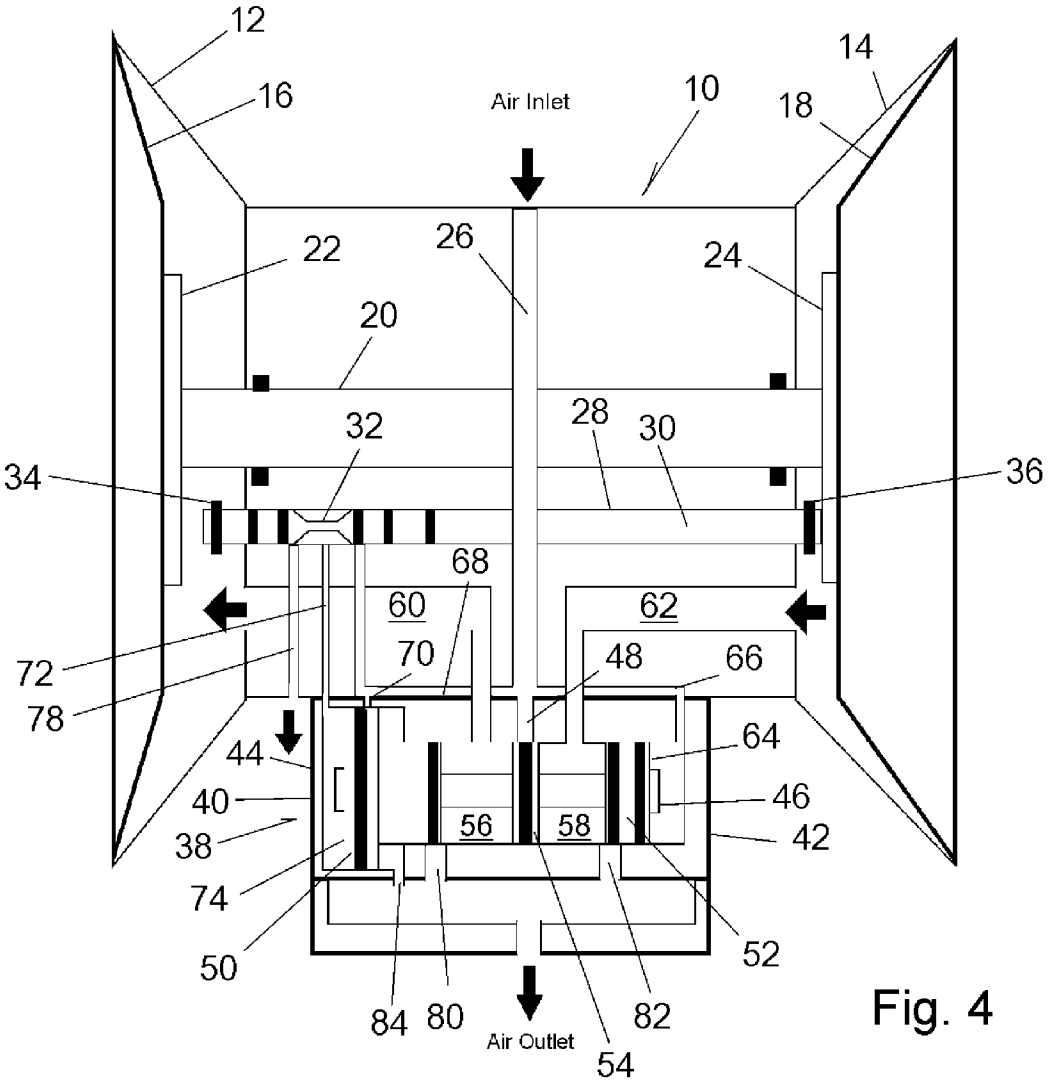
FIG. 4 is a schematic of the air motor showing the positions of the directional control valve and the pilot valve during shifting of the directional control valve in sequence following the position of the air motor as shown in FIG. 3.

FIG. 4 illustrates a next sequential position of the air motor. The pilot shaft 30 of the pilot valve 28 is shown to have partially shifted toward the air chamber 12 to exhaust air from the control passage 72 through the exhaust passage 78 to reduce pressure on the second piston surface 74. This allows the valve spool 46 to move to the left under the influence of the now unbalanced pressure on the first piston surface 64 through the first control air inlet passage 66. The land 54 continues to be in continuous communication with the process air inlet passage 48; but the process air may again be substantially or completely closed off from the passages 56, 58 for an instant during the shift of the directional control valve 38. Before the land 54 reaches the position illustrated in FIG. 4, flow was restored through the restricted port 70 to again be in communication with the third piston surface 76. The next sequential view would then again be the configuration of FIG. 1.

Considering specifically the restricted port 70 during operation of the air motor 10 at the moment the process air is shifted in its delivery to the air chambers 12, 14, as illustrated in FIGS. 2 and 4, the restricted port 70 is open to the third piston surface 76. The restricted port 70 is continuously in communication with the source of pressurized air 26 through the second control air inlet passage 68. Exposure to either of the second piston surface 74 and third piston surface 76 enhances the shifting of the valve spool 46 of the directional control valve 38. Minimizing the amount of displacement across the seal of the piston 50 enables the restricted port 70 to give boost to either the pressure communication to the second piston surface 74 or third piston surface 76 so as to minimize the opportunity for the directional control valve 38 to stall. Yet it has been recognized that communication through the restricted port 70 with the third piston surface 76 at the point the land 54 traverses the process air inlet passage 48 is advantageous to avoid air motor stall. In the preferred embodiment, the spool 46 is mounted vertically in the cylindrical cavity of the directional control valve 38 to provide a small gravitational bias to the valve spool 46 as well.

Thus, an improved reciprocating air motor has been disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An air motor, comprising:

a source of pressurized air;

two air chambers;

a directional control valve including two air distribution passages in communication with the two air chambers, respectively, a reciprocating valve spool having a land in continuous communication with the source of pressurized air, a first piston surface in continuous communication with the source of pressurized air, a second piston surface larger than the first piston surface in alternating communication with the source of pressurized air and with atmosphere and a third piston surface in continuous communication with atmosphere, the land being pneumatically between the two air distribution passages and controlling communication between the source of pressurized air and the two air distribution passages, and a restricted port in continuous communication with the source of pressurized air, the restricted port being flow restricted to provide partial pressure above atmosphere on the third piston surface and being in alternating communication with the second piston surface and the third piston surface, the first and third piston surfaces being opposed to the second piston surface.

2. The air motor of claim 1 further comprising:

a pilot valve, the second piston surface being in alternating communication through the pilot valve with the source of pressurized air and with atmosphere.

3. An air motor, comprising:

a source of pressurized air;

two air chambers;

a directional control valve including two air distribution passages in communication with the two air chambers, respectively, a reciprocating valve spool having a land in continuous communication with the source of pressurized air, a first piston surface in continuous communication with the source of pressurized air, a second piston surface larger than the first piston surface in alternating communication with the source of pressurized air and with atmosphere and a third piston surface in continuous communication with atmosphere, the land being pneumatically between the two air distribution passages and controlling communication between the source of pressurized air and the two air distribution passages, and a restricted port in continuous communication with the source of pressurized air, the restricted port being flow restricted to provide partial pressure above atmosphere on the third piston surface and being in alternating communication with the second piston surface and the third piston surface, the land traversing the air inlet passage with the third piston surface in communication with the source of pressurized air through the restricted port, the first and third piston surfaces being opposed to the second piston surface.

4. The air motor of claim 3 further comprising:

a pilot valve, the second piston surface being in alternating communication through the pilot valve with the source of pressurized air and with atmosphere.

5. An air motor, comprising:

a source of pressurized air;

two air chambers;

a directional control valve including two air distribution passages in communication with the two air chambers, respectively, a reciprocating valve spool having a land in continuous communication with the source of pressurized air, a first piston surface in continuous communication with the source of pressurized air, a second piston surface larger than the first piston surface in alternating communication with the source of pressurized air and with atmosphere and a third piston surface in continuous communication with atmosphere, the land being pneumatically between the two air distribution passages and controlling communication between the source of pressurized air and the two air distribution passages, and a restricted port in continuous communication with the source of pressurized air, the restricted port being flow restricted relative to the communication of the third piston surface with atmosphere and in alternating communication with the second piston surface and the third piston surface, the land traversing the air inlet passage with the third piston surface in communication with the source of pressurized air through the restricted port, the first and third piston surfaces being opposed to the second piston surface.

6. The air motor of claim 5 further comprising:

a pilot valve, the second piston surface being in alternating communication through the pilot valve with the source of pressurized air and with atmosphere.

* * * * *